United States Patent [19]

Zehe

[11] 4,070,968

[45] Jan. 31, 1978

[54] GRIPPER FOR PRINTING MACHINES

[75] Inventor: Alfred Zehe, Walldorf, Germany

[73] Assignee: Heidelberger Druckmaschinen Aktiengesellschaft, Heidelberg, Germany

[21] Appl. No.: 720,630

[22] Filed: Sept. 7, 1976

[30] Foreign Application Priority Data

Sept. 10, 1975 Germany ..... 2540218

[51] Int. Cl.[2] ..... B41F 21/04

[52] U.S. Cl. ..... 101/408; 271/204; 271/82; 271/85

[58] Field of Search ..... 101/407 A, 408–410, 101/230–233; 271/82, 277, 85, 204–206; 270/10, 14, 47, 60, 78

[56] References Cited

U.S. PATENT DOCUMENTS

| | | | |
|---|---|---|---|
| 2,509,030 | 5/1950 | Banthin | 101/408 |
| 2,950,914 | 8/1960 | Golding | 271/277 |

FOREIGN PATENT DOCUMENTS

| | | | |
|---|---|---|---|
| 259,237 | 5/1913 | Germany | 101/409 |
| 585,593 | 10/1933 | Germany | 101/408 |

*Primary Examiner*—Edgar S. Burr
*Assistant Examiner*—William Pieprz
*Attorney, Agent, or Firm*—Herbert L. Lerner

[57] ABSTRACT

A gripper assembly for a printing machine, a gripper member having a gripper tip formed with a free edge and a clamping face thereat, the clamping face being cooperably with a gripper support for gripping a sheet therebetween, the clamping face being trapezoidal and having the longer of the two parallel sides thereof disposed in vicinity of the free edge of the gripper tip.

3 Claims, 2 Drawing Figures

GRIPPER FOR PRINTING MACHINES

Figure 1:
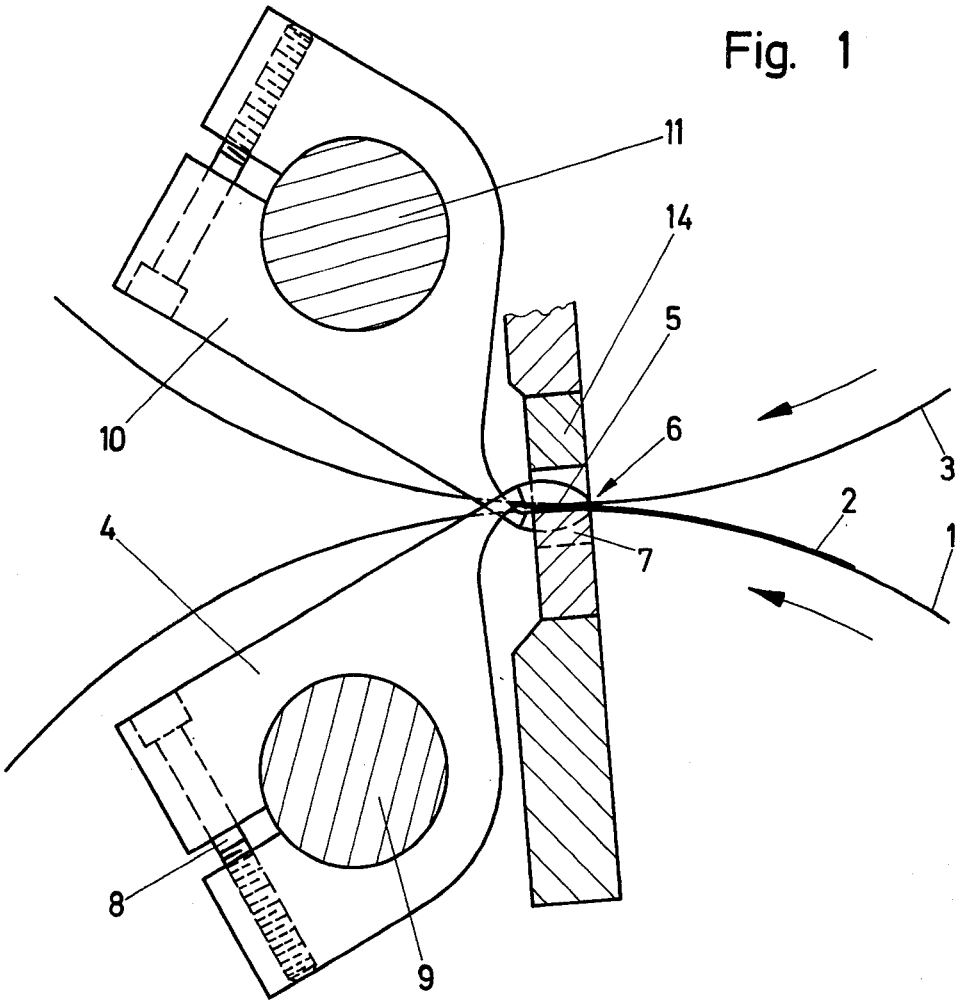

The invention relates to a gripper for printing-machines and, more particularly, such a gripper having a clamping face at the tip of the gripper which cooperates with a gripper support.

Such grippers are used, for example, on transfer drums in rotary sheet printing machines, gripping the front edge of the sheet which is to be conveyed. In transfering the sheet from one drum to the other, the grippers of the receiving drum must have previously gripped the front edge of the sheet, before the grippers of the delivering drum release the sheet. This is necessary in order to achieve appropriately registered prints where there are a number of printing units or mechanisms disposed in tandem or series.

To reliably grip the sheets, a multiplicity of grippers are distributed over the length of the drums. During transfer of the sheet, the grippers of the two drums grip the sheet close to one another. If the clamping surface on the grippers were of rectangular shape, danger would exist of the sheet tearing along the front edge thereof between two grippers of different drums. If the grippers grip the sheet at a slight distance from one another and if the delivering grippers open somewhat belatedly, tearing of the front edge of the sheet cannot be avoided. In order to avoid mackling and wastage, the printer is then compelled to stop the machine and carry out sensitive adjustments on the gripper delivery cam.

It is accordingly an object of the invention to provide a gripper for printing machines which avoids the foregoing disadvantages and which, more specifically, in relatively simple manner prevents the front edge of the sheet from becoming torn during sheet transfer.

With the foregoing and other objects in view, there is provided, in accordance with the invention, in a gripper assembly for a printing machine, a gripper member having a gripper tip formed with a free edge and a clamping face thereat, the clamping face being cooperable with a gripper support for gripping a sheet therebetween, the clamping face being trapezoidal and having the longer of the two parallel sides, thereof disposed in vicinity of the free edge of the gripper tip.

In accordance with another feature of the invention, the gripper tip is formed with identations at both non-parallel sides of the trapezoidal clamping face thereof.

In accordance with a further feature of the invention, the indentations are inwardly inclined from the longer of the two parallel sides of the trapezoidal clamping face.

The indentations thus considerably increase the distance between the clamping faces of two adjacently disposed grippers in the vicinity of the leading edge of the sheet. As a result thereof, in the event the leading edge of the sheet is undulatingly or wavily deflected by the grippers, it can accommodate or adapt itself readily thereto without tearing.

Other features which are considered as characteristic for the invention are set forth in the appended claims.

Although the invention is illustrated and described herein as embodied in gripper for printing machines, it is nevertheless not intended to be limited to the details shown, since various modifications and structural changes may be made therein without departing from the spirit of the invention and within the scope and range of equivalents of the claims.

Figure 2:
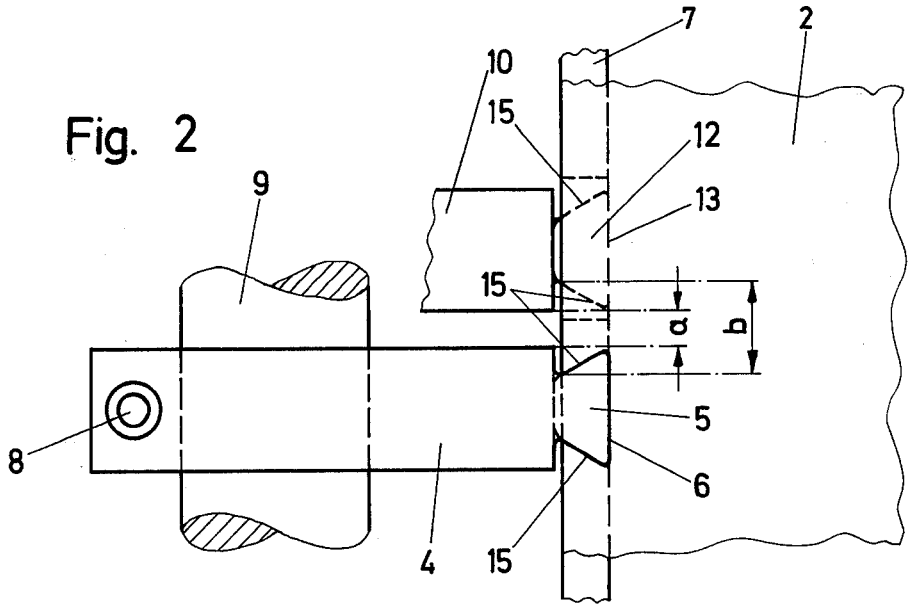

The construction and method of operation of the invention, however, together with additional objects and advantages thereof will be best understood from the following description of specific embodiements when read in connection with the accompanying drawing, in which:

FIG. 1 is a side elevational view, partly diagrammatic and partly in section, of the grippers according to the invention during sheet transfer; and FIG. 2 is a plan view of FIG. 1, one of the grippers being broken and partly omitted to prevent obstruction of detail.

Referring now to the figures of the drawing, there is shown a sheet 2 supplied by a drum 1 of a printing machine and fed to a drum 3 thereof. In a conventional manner, the sheet 2 is held fast on a gripper support 7 by a clamping face 5 on a tip 6 of a gripper 4. The gripper 4 is clamped by means of a screw 8 on a gripper shaft 9 secured to the delivering drum 1.

The receiving drum 3 is likewise provided with a gripper 10 which is mounted on a gripper shaft 11 secured to the drum 3. This gripper 10 is disposed in mirror-image relationship to the gripper 4 and cooperates with a gripper support 14 (FIG. 1) in a manner similar to the cooperating of the gripper 4 and gripper support 7. In the nip 1 and 3, the gripper 10 is closed initally and takes over the sheet 2. Immediately thereafter, the gripper 4 opens and releases the sheet 2.

FIG. 2 shows the two adjacently disposed grippers 4 and 10, of which the gripper 4 is mounted by the gripper shaft 9 in the drum 1, and the gripper 10 is mounted by the gripper shaft 11 (FIG. 1) in the sheet-receiving drum 3. The brief instant of time when both grippers 4 and 10 grip the front edge of the sheet 2 is illustrated in FIG. 2. The clamping face 5 of the gripper 4 and the clamping face 12 of the gripper 10, according to the invention, are of trapezoidal shape. The longer parallel side of the trapezoid, as shown in FIG. 2, is disposed in the region of the gripper points 6 and 13. Due to the trapezoidal shape of the clamping faces 5 and 12 and the indentations or notches 15 provided therefor at the sides of the grippers 4 and 10, for a given distance *a* between the two grippers 4 and 10 there is accordingly provided a distance *b* within which the front edge of a sheet is not gripped by the grippers 4 and 10. In the event the front edge of the sheet is undulatingly or wavily deflected by differences in travel of the two gripper supports 7 and 12, it can be accommodated or adapted thereto without tearing. The differences in travel of the two gripper supports 7 and 14 can then take effect if the delivering gripper 4 opens somewhat belatedly. Tearing is also to be feared if the two gripper supports 7 and 14 have a greater spacing from one another than the tickness of the sheet which is to be processed, so that when the two grippers 4 and 10 close, the front edge of the sheet likewise becomes undulating or wave-shaped. In this case, too, due to the formation of the clamping faces 5 and 12 of the respective grippers 4 and 10 in accordance with the invention prevents tearing of the front edge of the sheet.

There are claimed:

1. In a gripper assembly for a printing machine, having a rotary member for carrying a sheet to be printed a gripper member mounted on the rotary and member having a gripper tip formed with a free edge and a clamping face thereat, said clamping face being cooperable with a gripper support for gripping the sheet therebetween, said clamping face being trapezoidal and having a pair of non-parallel sides and a pair of parallel sides of unequal length connecting said pair of non parallel sides the longer of the two parallel sides thereof being disposed at the free edge of said gripper tip whereby the gripped sheet extends beyond the longer of the two parallel sides of said clamping face and along said non-parallel sides thereof.

2. Gripper member according to claim 1 wherein said gripper tip is formed with indentations at both non-parallel sides of the trapezoidal clamping face thereof.

3. Gripper member according to claim 2 wherein said indentations are inwardly inclined from the longer of the two parallel sides of the trapezoidal clamping face.

* * * * *